United States Patent [19]

Santiago et al.

[11] 4,155,980

[45] May 22, 1979

[54] APPARATUS FOR CATALYTIC PURIFYING THE EFFLUENT GASES OF INTERNAL COMBUSTION ENGINES

[75] Inventors: Enrique Santiago, Diedorf; Peter Preissinger; Jurgen Brich, both of Augsburg, all of Fed. Rep. of Germany

[73] Assignee: Zeuna-Starker KG, Augsburg, Fed. Rep. of Germany

[21] Appl. No.: 824,048

[22] Filed: Aug. 12, 1977

Related U.S. Application Data

[63] Continuation-in-part of Ser. No. 807,676, Jun. 17, 1977, abandoned.

[30] Foreign Application Priority Data

Jun. 19, 1976 [DE] Fed. Rep. of Germany ..... 2627596

[51] Int. Cl.[2] ..... B01J 8/02; B01J 35/04; F01N 3/15

[52] U.S. Cl. ..... 422/180; 422/179

[58] Field of Search ..... 23/288 FC; 422/177, 422/179, 180; 60/299, 301

[56] References Cited

U.S. PATENT DOCUMENTS

| | | | |
|---|---|---|---|
| 3,441,381 | 4/1969 | Keith et al. | 23/288 FC |
| 3,854,888 | 12/1974 | Frietsche et al. | 23/288 FC |

FOREIGN PATENT DOCUMENTS

| | | | |
|---|---|---|---|
| 2245535 | 4/1974 | Fed. Rep. of Germany | 23/288 FC |
| 2301646 | 8/1974 | Fed. Rep. of Germany | 23/288 FC |
| 2313166 | 9/1974 | Fed. Rep. of Germany | 23/288 FC |
| 2412863 | 10/1974 | Fed. Rep. of Germany | 23/288 FC |
| 2341265 | 6/1975 | Fed. Rep. of Germany | 23/288 FC |
| 2442488 | 3/1976 | Fed. Rep. of Germany | 23/288 FC |
| 1406704 | 9/1975 | United Kingdom | 23/288 FC |

*Primary Examiner*—Michael S. Marcus

*Attorney, Agent, or Firm*—Cushman, Darby & Cushman

[57] ABSTRACT

Apparatus for catalytic purification of internal combustion gases wherein a cylindrical catalyst body is housed in an external housing between which a shock absorbing resilient envelope is interposed. A seal ring is provided at least one end of the body extending outwardly from the frontal edge into abutment with the housing.

5 Claims, 3 Drawing Figures

APPARATUS FOR CATALYTIC PURIFYING THE EFFLUENT GASES OF INTERNAL COMBUSTION ENGINES

RELATED APPLICATION

This application is a continuation in part of Ser. No. 807,676, filed June 17, 1977, now abandoned.

BACKGROUND OF THE INVENTION

The present invention relates to apparatus for the catalytic purification of the exhaust gases in internal combustion engines wherein a cylindrical catalyst body traversed by the gas in the axial direction, is arranged in the interior of a sheet metal housing and is shock-dampened by means of a resilient envelope provided at its circumference which also seals the body relative to an outer housing.

When using delicate ceramic envelope materials, for example, on aluminum silicate base, premature wear thereof will occur without special sealing of the envelope at its end face. Such wear is caused on the one hand by the exhaust gas pulsations and on the other hand by the corrosive attack of the exhaust gases on the free front surface of the envelope.

To avoid this disadvantage, it has been proposed in German Patent Publication P 25 15 732, corresponding to U.S. Patent application Ser. No. 674,224, to deflect the exhaust gases into the interior of the catalyst body by sheet metal rings fastened to the housing. Such a measure gives no protection against chemical corrosion.

The problem underlying the invention is to seal the space between the catalyst body and the housing in a manner which not only ensures the complete closure thereof but also serves to retain the catalyst body.

SUMMARY OF THE INVENTION

According to the invention, this problem is solved by working, smoothing and/or calibrating the catalyst body at its circumferential zone contiguous to at least one of its frontal edges, and fitting thereon an elastic seal ring which extends beyond the frontal edge. The seal ring is radially extended to be forcibly applied at its free end against the inside of the outer housing wall about the entire circumference of the housing. Such a seal ring contributes both to the radial and to the axial retention of the catalyst body and achieves an elastic support of the catalyst body in the area of its opposite front edges.

At the same time the seal provides a hermetic closure of the space containing the shock-absorbing envelope between the catalyst body and the housing surrounding the latter. A precise calibration or working, i.e. smoothing, of the circumference of the catalyst body is necessary only in a limited area contiguous to the end faces. For the purpose of calibration, a layer of a cement type material, for example a material available on the market under the designation of Blakite, is applied. This layer causes an increased compression of the envelope in radial direction, whereby in particular the axial hold of the catalyst body is improved.

The assembly of the apparatus is facilitated by the fact that the housing may be divided into two half shells. The catalyst body, provided with the seal rings and wrapped with a shock attenuating elastic envelope, is placed into the lower half shell; then the upper half shell is pressed on, while clamping the free end sections of the seal rings relative to the inner wall of the housing.

Thereafter the two sections of the housing are together. After the union of the two half shells, the free end sections of the seal rings can be fixed relative to the shells by spot welding.

To achieve an improved spring action of the seal rings, the housing may have an annular axial enlargement in the contact area with the free end section of the seal ring, while the ring itself may be both radially and axially enlarged to firmly seat against the housing wall over an enlarged area. Thereby the free end section of the seal ring presses against the inner wall of the housing independently of the clamping of the resilient envelope to the housing. At the same time the enlargement serves to provide a certain axial fixation of the catalyst body, as the free end section of the seal ring engages securely in locking form against the housing.

An improvement of the exhaust gas conduction can be further achieved by reducing the diameter of the seal ring radially inward, in its middle section. This concentrates the exhaust gases closer to the axis of the catalyst since the smallest diameter of the ring is smaller than the outside diameter of the catalyst body. With this form of exhaust gas conduction, an optimal utilization of the effective surface of the catalyst body during flow through it is obtained.

An example of construction of the device according to the invention is explained in the following description with reference to the accompanying drawing.

DESCRIPTION OF THE INVENTION

Figure 1:
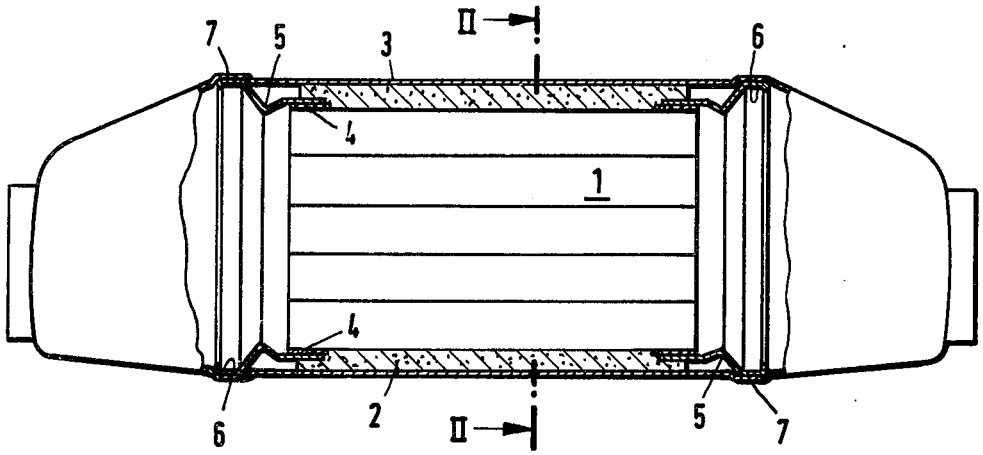
FIG. 1 is an axial section through the catalyst device.
Figure 2:
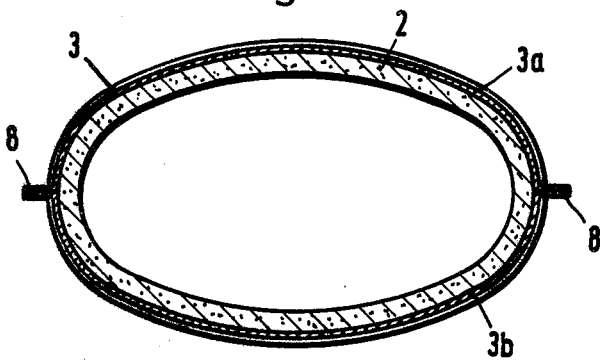
FIG. 2 is a transverse section along II—II of FIG. 1.

The catalyst body 1 is a monolithic, substantially cylindrical or uniform cross-sectional axially traversible block, carrying about its circumference, a resilient envelope 2 made of an aluminum silicate based material, for example a material commercially available under the designation and trademark Cera Blanket or Saffil. The Cera Blanket is a mat of fireproof ceramic fibres of about 60% aluminum oxide and $Na_2O$, 39% silicon dioxide and a small remainder of $FeO_3$, $TiO_2$. Saffil is a mat of fireproof ceramic fibres of about 95% aluminum oxide and 5% silicon dioxide, with some trace elements. The envelope 2 clamps the catalyst body 1 in radial direction relative to the sheet metal housing 3, which surrounds it. The sheet metal housing has inwardly tapering ends, which has a form corresponding to the catalyst body 1 and is provided in known measure with means for connection to the exhaust of an engine. In the present instance the form of the catalyst body and housing is approximately elliptical in cross-section as seen in FIG. 2. Preferably, the housing is slightly smaller in its diameters so as to apply a tight closing pressure on the envelope 2 and catalyst body 1. The catalyst body 1 is formed, in its circumferential end zones 4 (contiguous to the frontal edges) with recessed surfaces on which is fit a ring 5. The catalyst body is calibrated at the zones 4, by application of a cement type mass, e.g. of a material commercially available on the market under the name Blakite. Blakite is a mortar comprising fireproof clay and cyanite mixed with water glass; water glass being another expression for sodium-tetrasilicate. The term calibrated as used herein means to treat the catalyst body on its circumferential zones 4 as by coating the same with the mortar or other material until a certain outer diameter is reached within small tolerances for the set up and close fit of the rings 5. The rings 5, are resilient seal rings formed of suitable metal which are seated onto these recessed surfaces so as to be axially fixed at their outer end and to have their free outer end sections 6 radially extended in an arched portion 7 which engages the housing 3. The end sections 6 may be connected with the housing by spot welding in the region of the arched portions 7 forming an annular enlargement of the rings 5, beyond the diameter of the catalyst body. The resilient envelope material is at least partially pulled over the seal rings 5 in the end region of the catalyst body 1.

Footnote: The manufacturer of Saffil is ICI-Imperial Chemical Industries Ltd., Runcorn, Cheshire, England, and of Blakite and Cerablanket is Johns-Manville International Corp., New York, U.S.A.

As can be seen in FIG. 2, the outer metallic housing 3 is divided into two half shells 3*a* and 3*b*, which are connected together by spot welding at their laterally circling flanges 8.

Figure 3:
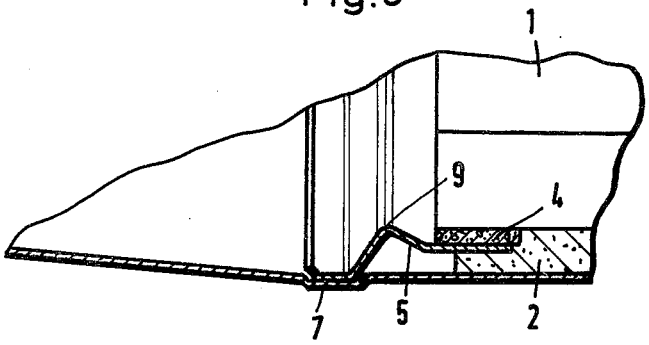
FIG. 3 is an enlarged view of a segment of a seal ring shown in FIG. 1, illustrating its construction in cross-section.

FIG. 3 shows a segment of a seal ring 5 which is provided with a radially inward cross-section annular reduction or fold 9, which has an inner diameter smaller than the outside diameter of the catalyst body. The latter fold causes a deflection of the exhaust gas stream from its axial path radially, hence concentrating the gas stream. The fold also enables the ring to be radially and axially movable.

It will be seen from the foregoing that the various objects and advantages of the present invention, enumerated earlier, are all obtained in simple economical fashion. Various modifications and changes have been suggested in the foregoing description. Others will be obvious to those skilled in this art. Consequently, it is intended that the present disclosure be illustrative only and not limiting of the scope of the invention.

What is claimed is:

1. Apparatus for catalytic purification of exhaust gases in an internal combustion engine comprising a catalyst body adapted to be traversed by said gases in the axial direction, a sheet metal housing surrounding said body and a shock absorbing envelope interposed therebetween, a seal ring secured about the circumference of said body adjacent at least one end thereof, said seal ring extending beyond the frontal edge of said one end and having a free section abutting against the inside surface of said housing about the entire circumference thereof, said catalyst body being calibrated in a circumferential zone about said body adjacent said at least one end thereof, so that said seal ring may be fit thereto, by applying a layer of cement type material between the catalyst body and said seal ring in said circumferential zone and said housing having an annular surface enlarged in the radial direction receiving the free end section of the seal ring for sealing said ring.

2. Apparatus for catalytic purification of exhaust gases in an internal combustion engine comprising a catalyst body adapted to be traversed by said gases in the axial direction, a sheet metal housing surrounding said body and a shock absorbing envelope interposed therebetween, a seal ring secured about the circumference of said body adjacent at least one end thereof, said seal ring extending beyond the frontal edge of said one end and having a free section independent of but pressing against the inside surface of said housing about the entire circumference thereof said housing having means receiving said free end for providing a substantial axial fixation of said catalyst body said catalyst body being calibrated in a circumferential zone about said body adjacent said at least one end thereof, so that said seal ring may be fit thereto, by applying a layer of cement type material between the catalyst body and said seal ring in said circumferential zone and said seal ring being formed in its middle section with a radially inwardly directed annulus of a reduced diameter serving to concentrate the exhaust gas.

3. The apparatus according to claim 2, wherein said housing comprises a pair of two half shells and meaning joining said half shells together along their edges.

4. The apparatus according to claim 2, wherein the diameter of said inwardly directed annulus is smaller than the outside diameter of the catalyst body.

5. The apparatus according to claim 2, wherein the frontal edge of said catalyst body is recessed to receive the end of said seal ring.

* * * * *